US010703531B2

(12) United States Patent
Apps et al.

(10) Patent No.: US 10,703,531 B2
(45) Date of Patent: Jul. 7, 2020

(54) COLLAPSIBLE CRATE WITH WOOD APPEARANCE

(71) Applicant: Rehrig Pacific Company, Los Angeles, CA (US)

(72) Inventors: William P. Apps, Alpharetta, GA (US); Jon P. Hassell, Atlanta, GA (US); Shelby Frances Apps, Brookhaven, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 190 days.

(21) Appl. No.: 15/455,786

(22) Filed: Mar. 10, 2017

(65) Prior Publication Data

US 2017/0275049 A1 Sep. 28, 2017

Related U.S. Application Data

(60) Provisional application No. 62/307,083, filed on Mar. 11, 2016.

(51) Int. Cl.
*B65D 6/18* (2006.01)
*B65D 6/00* (2006.01)

(52) U.S. Cl.
CPC ..... *B65D 11/1833* (2013.01); *B65D 11/20* (2013.01); *B65D 2205/00* (2013.01); *B65D 2205/02* (2013.01)

(58) Field of Classification Search
CPC ..... B65D 11/1833; B65D 11/18
USPC ..... 220/6, 7, 4.34
See application file for complete search history.

(56) References Cited

U.S. PATENT DOCUMENTS

| | | | |
|---|---|---|---|
| 705,045 | A | 7/1902 | Davidson |
| 785,451 | A | 3/1905 | Tourville |
| 826,600 | A | 7/1906 | Oakman |
| 882,184 | A | 3/1908 | Willard |

(Continued)

FOREIGN PATENT DOCUMENTS

| | | |
|---|---|---|
| DE | 2160601 | 6/1972 |
| EP | 73357 A2 | 3/1983 |

(Continued)

OTHER PUBLICATIONS

Big Texture, https://www.bigtexture.com/textures/texture-651, Jun. 21, 2015 (Year: 2015).*

(Continued)

*Primary Examiner* — Jefffrey R Allen
(74) *Attorney, Agent, or Firm* — Carlson, Gaskey & Olds, P.C.

(57) ABSTRACT

A collapsible crate includes a base and a plurality of walls pivotably connected to the base. Each of the walls is a single piece of molded plastic defining a plurality of planks having the appearance of wooden planks, such as with molded-in grain texture, knots and irregular edges. The irregular edges may provide gaps between adjacent planks to provide ventilation to the crate. The knots may include knot holes to provide additional ventilation. The planks may include horizontal planks extending between vertical planks. The vertical planks and horizontal planks may include an interior wall from the edges of which extend ribs toward the exterior of the crate.

26 Claims, 15 Drawing Sheets

(56) References Cited

U.S. PATENT DOCUMENTS 1,028,933 A 6/1912 Compton
1,330,338 A 2/1920 Peavy
1,389,199 A 8/1921 Lee
1,407,054 A 2/1922 Farley
1,443,901 A 1/1923 Murray
1,611,629 A 12/1926 Artas
1,671,051 A 5/1928 Soderquist
1,809,523 A 6/1931 Mclean
1,869,071 A 7/1932 Mclean
1,980,482 A 11/1934 Golden
2,007,296 A 7/1935 Crawford
2,462,693 A 2/1949 Wabshaw
2,497,453 A 2/1950 Hazen
2,667,398 A 1/1954 Claflin
2,714,466 A 8/1955 Killeen
2,731,761 A 1/1956 Marshall
2,759,622 A 8/1956 Simmons
2,760,669 A 8/1956 Kreutzer
2,780,381 A 2/1957 Coit, Jr.
2,785,822 A 3/1957 Kus
2,847,794 A 8/1958 Loud
2,868,406 A 1/1959 Kookogey
3,000,049 A 9/1961 Terry, Jr.
3,048,147 A 8/1962 Mckean
3,095,965 A 7/1963 Stahl
3,122,127 A 2/1964 Shechmeister
3,130,850 A 4/1964 Oakey
3,220,603 A 11/1965 Bromley
3,311,254 A 3/1967 Beh
3,360,180 A 12/1967 Venturi
3,372,829 A 3/1968 Averill
3,398,850 A 8/1968 Kennard
3,446,145 A 5/1969 Weeks
3,446,415 A 5/1969 Bromley
3,497,127 A 2/1970 Box
3,516,592 A 6/1970 Friedrich
3,591,212 A 7/1971 Rhyne
3,747,794 A 7/1973 Bitney
3,770,186 A 11/1973 Kupersmit
3,782,579 A 1/1974 Zarges
3,796,342 A 3/1974 Sanders et al.
3,804,033 A 4/1974 Izawa et al.
3,814,220 A 6/1974 Brody
3,821,861 A 7/1974 Jalbert
3,853,238 A 12/1974 Luisada et al.
3,874,546 A 4/1975 Sanders et al.
3,941,271 A 3/1976 Zarges et al.
3,955,703 A 5/1976 Zebarth
3,970,209 A 7/1976 Baxter
3,973,692 A 8/1976 Cloyd
3,981,410 A 9/1976 Schurch
4,005,795 A 2/1977 Mikkelsen et al.
4,030,232 A 6/1977 Niva
4,030,600 A 6/1977 Heaps
4,043,476 A 8/1977 Joseph
4,044,910 A 8/1977 Box
4,062,467 A 12/1977 Friedrich
4,081,099 A 3/1978 Shead
4,109,791 A 8/1978 Clipson et al.
4,120,417 A 10/1978 Aquino
4,148,407 A 4/1979 Sinclair
4,159,591 A 7/1979 Plante
4,163,495 A 8/1979 Drader
4,170,313 A 10/1979 Caves et al.
4,181,236 A 1/1980 Prodel
4,186,841 A 2/1980 Buckley et al.
4,192,430 A 3/1980 Cornou
4,235,345 A 11/1980 VandeDrink et al.
4,241,831 A 12/1980 Locatelli
4,300,695 A * 11/1981 Hsu ..... B65D 11/1833
220/4.34
4,314,686 A 2/1982 Marz
4,320,845 A 3/1982 Waller
4,342,393 A 8/1982 Box
4,391,369 A 7/1983 Stahl et al.
4,406,380 A 9/1983 Paige
4,417,686 A 11/1983 Wozniacki
4,423,813 A 1/1984 Kreeger et al.
4,591,065 A 5/1986 Foy
4,648,199 A 3/1987 Deaton et al.
4,648,200 A 3/1987 Miller et al.
4,662,532 A 5/1987 Anderson et al.
4,663,803 A 5/1987 Gora
4,676,534 A 6/1987 Hix, Jr.
4,693,386 A 9/1987 Hughes et al.
4,720,020 A 1/1988 Su
4,726,486 A 2/1988 Masuda
4,735,330 A 4/1988 Hoss
4,735,331 A 4/1988 Keenan et al.
4,759,149 A 7/1988 Dunn
4,775,068 A 10/1988 Reiland et al.
4,781,300 A 11/1988 Long
4,798,304 A 1/1989 Rader
4,807,774 A 2/1989 Karpisek
4,820,383 A 4/1989 Shchamorov et al.
4,846,089 A 7/1989 Cedergreen
4,848,578 A 7/1989 Schafer
4,863,062 A 9/1989 Holliday
4,887,747 A 12/1989 Ostrowsky et al.
4,887,874 A 12/1989 Joffe
4,909,188 A 3/1990 Tominaga
4,917,255 A 4/1990 Foy et al.
4,923,079 A 5/1990 Foy
4,953,735 A 9/1990 Tisbo et al.
4,960,223 A 10/1990 Chiang et al.
4,967,927 A 11/1990 Reiland et al.
5,016,772 A 5/1991 Wilk
5,022,529 A 6/1991 Kang
5,038,953 A 8/1991 Radar
5,048,715 A 9/1991 Wolff
5,076,457 A 12/1991 Marovskis
5,092,270 A 3/1992 Simons et al.
5,094,356 A 3/1992 Miller
5,109,980 A 5/1992 Matsuoka et al.
5,114,037 A 5/1992 Hillis et al.
5,161,709 A 11/1992 Oestreich, Jr.
5,199,592 A 4/1993 Reiland et al.
5,289,935 A 3/1994 Hillis et al.
5,331,763 A 7/1994 Miller
5,398,834 A 3/1995 Umiker
5,398,835 A 3/1995 Blinstrub
5,429,261 A 7/1995 Machino
5,467,885 A 11/1995 Blinstrub
5,474,197 A 12/1995 Hillis et al.
5,501,354 A 3/1996 Stromberg
5,515,987 A 5/1996 Jacques et al.
5,538,153 A 7/1996 Marovskis et al.
5,558,241 A 9/1996 Huffstutler, Jr. et al.
5,562,224 A 10/1996 Pascal et al.
5,564,599 A 10/1996 Barber et al.
5,586,675 A 12/1996 Borsboom et al.
5,588,549 A 12/1996 Furtner
5,595,305 A 1/1997 Hart
5,622,276 A 4/1997 Simmons
5,632,114 A 5/1997 McKenzie
5,632,392 A 5/1997 Oh
5,660,291 A 8/1997 Dash
5,671,857 A 9/1997 Stromberg
5,699,926 A 12/1997 Jacques et al.
5,720,405 A 2/1998 Karpisek
5,746,342 A 5/1998 Jacques et al.
5,788,103 A 8/1998 Wagner et al.
5,797,508 A 8/1998 Loftus et al.
5,829,617 A 11/1998 Umiker
5,853,099 A 12/1998 Lessard
5,918,743 A 7/1999 Uitz
5,938,059 A 8/1999 Luburic
5,950,546 A 9/1999 Brown et al.
5,967,356 A 10/1999 Laarhoven et al.
5,975,324 A 11/1999 Schmitt
5,988,420 A 11/1999 Jacques et al.
6,015,056 A 1/2000 Overholt et al.
6,029,840 A 2/2000 Brauner
D423,217 S 4/2000 Vaifeldt

(56) References Cited

U.S. PATENT DOCUMENTS

| | | | |
|---|---|---|---|
| D424,299 | S | 5/2000 | Vaifeldt |
| 6,056,177 | A | 5/2000 | Schneider |
| 6,073,790 | A | 6/2000 | Umiker |
| 6,082,570 | A | 7/2000 | Tai |
| 6,098,827 | A | 8/2000 | Overholt et al. |
| 6,131,757 | A | 10/2000 | Clark et al. |
| 6,138,851 | A | 10/2000 | Townson |
| 6,142,329 | A | 11/2000 | Dotan |
| 6,170,689 | B1 | 1/2001 | Flesher et al. |
| 6,189,695 | B1 | 2/2001 | Ching-rong |
| 6,209,742 | B1 | 4/2001 | Overholt et al. |
| 6,267,079 | B1 | 7/2001 | Eby |
| 6,283,319 | B1 | 9/2001 | Hillis et al. |
| 6,286,701 | B1 | 9/2001 | Umiker |
| 6,290,081 | B1 | 9/2001 | Merey |
| 6,293,417 | B1 | 9/2001 | Varfeldt |
| 6,293,418 | B1 | 9/2001 | Ogden et al. |
| 6,305,566 | B1 | 10/2001 | Pigott et al. |
| D452,614 | S | 1/2002 | Overholt |
| 6,386,388 | B1 | 5/2002 | Overholt |
| D458,753 | S | 6/2002 | Overholt |
| 6,398,054 | B1 | 6/2002 | Overholt et al. |
| 6,401,953 | B2 | 6/2002 | Kofod |
| 6,405,888 | B1 | 6/2002 | Overholt et al. |
| 6,409,041 | B1 | 6/2002 | Overholt et al. |
| 6,415,938 | B1 | 7/2002 | Karpisek |
| 6,446,825 | B1 | 9/2002 | Godoy |
| 6,460,717 | B1 | 10/2002 | Smyers et al. |
| D466,392 | S | 12/2002 | Halajko |
| 6,488,168 | B1 | 12/2002 | Wang |
| 6,601,724 | B1 | 8/2003 | Koefelda et al. |
| 6,623,059 | B2 | 9/2003 | Gehring et al. |
| 6,631,822 | B1 | 10/2003 | Overholt |
| 6,669,044 | B2 | 12/2003 | Murakami et al. |
| 6,691,885 | B2 | 2/2004 | Brown |
| 6,702,135 | B2 | 3/2004 | Pickler |
| 6,722,516 | B1 | 4/2004 | Zelko |
| 6,772,897 | B2 | 8/2004 | Kellerer et al. |
| 6,820,761 | B1 | 11/2004 | Mouri et al. |
| 6,863,180 | B2 | 3/2005 | Apps et al. |
| 6,899,242 | B2 | 5/2005 | Overholt et al. |
| 6,918,502 | B1 | 7/2005 | Overholt et al. |
| 6,981,605 | B2 | 1/2006 | Kasuya et al. |
| 7,011,225 | B2 | 3/2006 | Oster et al. |
| 7,017,765 | B2 | 3/2006 | Overholt |
| 7,017,766 | B2 | 3/2006 | Hsu et al. |
| 7,044,319 | B2 | 5/2006 | Overholt et al. |
| 7,048,134 | B1 | 5/2006 | Hagan |
| 7,059,489 | B2 | 6/2006 | Apps et al. |
| 7,100,786 | B2 | 9/2006 | Smyers |
| 7,104,414 | B2 | 9/2006 | Apps et al. |
| 7,128,231 | B2 | 10/2006 | Overholt |
| 7,195,127 | B2 | 3/2007 | Hsu et al. |
| 7,195,128 | B2 | 3/2007 | Murakami et al. |
| 7,264,122 | B2 | 9/2007 | Koefelda et al. |
| 7,267,227 | B2 | 9/2007 | Dubois et al. |
| 7,281,637 | B2 | 10/2007 | Hadar |
| 7,353,962 | B2 | 4/2008 | Pamall et al. |
| 7,357,269 | B2 | 4/2008 | Apps |
| 7,438,197 | B2 | 10/2008 | Yamauchi |
| 7,484,634 | B2 | 2/2009 | Apps |
| 7,533,486 | B2 | 5/2009 | De Matos |
| 7,549,550 | B2 | 6/2009 | Smyers et al. |
| 7,556,166 | B2 | 7/2009 | Pamall et al. |
| 7,641,066 | B2 | 1/2010 | Baltz |
| 7,694,836 | B2 | 4/2010 | Overholt et al. |
| 7,717,283 | B2 | 5/2010 | Apps et al. |
| 7,726,502 | B2 | 6/2010 | Apps |
| 7,740,146 | B2 | 6/2010 | Cavalcante et al. |
| 7,823,728 | B2 | 11/2010 | Baltz |
| D628,801 | S | 12/2010 | Pouliot |
| 7,896,184 | B2 | 3/2011 | Meers |
| 8,056,723 | B2 | 11/2011 | Cavalcante |
| 8,066,147 | B2 | 11/2011 | Meers et al. |
| 8,091,706 | B2 | 1/2012 | Koefelda |
| 8,561,836 | B2 | 10/2013 | Cook |
| 9,278,775 | B2 | 3/2016 | Meers et al. |
| D777,433 | S * | 1/2017 | Feiner ..... D3/307 |
| D779,825 | S | 2/2017 | Feiner |
| D779,826 | S † | 2/2017 | Feiner |
| D779,827 | S | 2/2017 | Feiner |
| D787,827 | S | 5/2017 | Feiner |
| 2002/0070215 | A1 | 6/2002 | Walsh et al. |
| 2002/0092850 | A1 | 7/2002 | Iwahara et al. |
| 2002/0108950 | A1 | 8/2002 | Moorman et al. |
| 2002/0158067 | A1 | 10/2002 | Overholt et al. |
| 2003/0000950 | A1 | 1/2003 | Murakami et al. |
| 2003/0116564 | A1 | 6/2003 | Overholt et al. |
| 2003/0132228 | A1 | 7/2003 | Apps et al. |
| 2003/0136781 | A1 | 7/2003 | Rumpel |
| 2003/0155275 | A1 | 8/2003 | Apps et al. |
| 2003/0222081 | A1 | 12/2003 | Apps et al. |
| 2004/0020821 | A1 | 2/2004 | Koefelda et al. |
| 2004/0069780 | A1 | 4/2004 | Apps et al. |
| 2004/0099662 | A1 | 5/2004 | Overholt |
| 2004/0104231 | A1 | 6/2004 | Hassell et al. |
| 2004/0129700 | A1 | 7/2004 | Oster et al. |
| 2004/0159659 | A1 | 8/2004 | Rumpel |
| 2004/0178197 | A1 | 9/2004 | Hsu et al. |
| 2004/0182858 | A1 | 9/2004 | Smyers |
| 2004/0200833 | A1 | 10/2004 | Dubois et al. |
| 2004/0226945 | A1 | 11/2004 | Hsu et al. |
| 2005/0040166 | A1 | 2/2005 | Nolet et al. |
| 2005/0098556 | A1 | 5/2005 | Kellerer |
| 2005/0121447 | A1 | 6/2005 | Barth |
| 2005/0155967 | A1 | 7/2005 | Vial |
| 2005/0194382 | A1 | 9/2005 | B. |
| 2006/0011627 | A1 | 1/2006 | Overholt et al. |
| 2006/0181101 | A1 | 8/2006 | Reynolds et al. |
| 2006/0231555 | A1 | 10/2006 | Smyers et al. |
| 2006/0237341 | A1 | 10/2006 | McDade |
| 2006/0260976 | A1 | 11/2006 | Apps |
| 2007/0095842 | A1 | 5/2007 | Apps |
| 2007/0125779 | A1 | 6/2007 | Cope |
| 2007/0158345 | A1 | 7/2007 | Booth et al. |
| 2007/0187276 | A1 | 8/2007 | Stahl |
| 2007/0194023 | A1 | 8/2007 | Apps et al. |
| 2008/0142399 | A1 | 6/2008 | Apps |
| 2008/0142530 | A1 | 6/2008 | Meers et al. |
| 2008/0169285 | A1 | 7/2008 | Marazita et al. |
| 2008/0179322 | A1 | 7/2008 | Parnall et al. |
| 2008/0296308 | A1 | 12/2008 | Barbalho et al. |
| 2008/0302791 | A1 | 12/2008 | Baltz |
| 2009/0057320 | A1 | 3/2009 | Meers et al. |
| 2009/0078701 | A1 | 3/2009 | Cavalcante |
| 2009/0134157 | A1 | 5/2009 | Meers |
| 2009/0151226 | A1 | 6/2009 | Apps et al. |
| 2009/0159593 | A1 | 6/2009 | Apps |
| 2009/0223953 | A1 | 9/2009 | Cavalcante |
| 2010/0065558 | A1 | 3/2010 | Cavalcante et al. |
| 2011/0290811 | A1 | 12/2011 | Koefelda et al. |
| 2012/0037647 | A1 | 2/2012 | Cook |
| 2012/0111859 | A1 | 5/2012 | Pils et al. |
| 2012/0285951 | A1 | 11/2012 | Cavalcante |
| 2013/0193153 | A1 | 8/2013 | Baltz et al. |
| 2016/0185487 | A1 | 6/2016 | Meers et al. |

FOREIGN PATENT DOCUMENTS

| | | | |
|---|---|---|---|
| EP | 0127414 | A2 | 12/1984 |
| EP | 0178211 | A1 | 4/1986 |
| EP | 211116 | A2 | 2/1987 |
| EP | 385914 | A1 | 9/1990 |
| EP | 0404041 | A1 | 12/1990 |
| EP | 0485672 | A1 | 5/1992 |
| EP | 690003 | A1 | 11/1994 |
| EP | 0631938 | A2 † | 1/1995 |
| EP | 785142 | A1 | 7/1997 |
| EP | 0962394 | A1 | 12/1999 |
| EP | 962396 | A1 | 12/1999 |
| EP | 1114779 | A2 | 7/2001 |
| EP | 1160169 | A2 | 12/2001 |
| EP | 1225131 | A1 | 7/2002 |
| EP | 1241105 | A1 | 9/2002 |

(56) References Cited

FOREIGN PATENT DOCUMENTS

| | | | |
|---|---|---|---|
| EP | 2384989 81 | † | 5/2014 |
| GB | 2068338 | | 8/1981 |
| GB | 2139189 | | 11/1984 |
| GB | 2141778 | | 1/1985 |
| GB | 2337985 | | 12/1999 |
| GB | 2357078 | | 6/2001 |
| GB | 2360762 | | 10/2001 |
| GB | 2449502 | | 11/2008 |
| WO | 8601182 | A1 | 2/1986 |
| WO | 9324378 | A1 | 12/1993 |
| WO | 9521773 | A1 | 8/1995 |
| WO | 97026190 | | 1/1997 |
| WO | 9715502 | | 5/1997 |
| WO | 9726193 | | 7/1997 |
| WO | 9749613 | | 12/1997 |
| WO | 98040199 | | 1/1998 |
| WO | 0027716 | A1 | 5/2000 |
| WO | 0066440 | A1 | 11/2000 |
| WO | 0203463 | | 1/2002 |
| WO | 0206128 | | 1/2002 |
| WO | 03008275 | A2 | 1/2003 |
| WO | 03078259 | A1 | 9/2003 |
| WO | 03101846 | A1 | 12/2003 |
| WO | 2006010311 | | 2/2006 |
| WO | 2008145977 | A1 | 12/2008 |
| WO | 2011006654 | A1 | 1/2011 |

OTHER PUBLICATIONS

Photograph of IFCO Systems Crate. Feb. 1, 2016.

Photograph of Polymer Logistics Crate. Feb. 1, 2016.

Nivens, Jonathan; Polymer Logistics Feature the World's First Wood Effect Crate; pp. 1-5; May 6, 2014; www.andnowuknow.com.†

Deleon, Melissa; IFCO President of North America Daniel Walsh and Walmart VP of Produce and Floral Dom Wenninger Discuss New RPC Partnership; pp. 1-5; Oct. 29, 2015; www.andnowuknow.com.†

* cited by examiner
† cited by third party

COLLAPSIBLE CRATE WITH WOOD APPEARANCE

BACKGROUND

Collapsible crates are often used for transporting fruit or other produce to grocery stores from a warehouse or distribution facility. The crate includes a base with a plurality of walls hingeably connected about the perimeter of the base. The produce is shipped to the store inside the crates, which can be stacked during shipping. The produce may be removed from the crates inside the store and placed on shelves for display and sale. Alternatively, the crates may be placed directly on shelves for consumers to shop directly from the crates. The empty crates are collapsed to reduce volume during storage and shipping back to the warehouse for reuse.

Some collapsible crates have been offered that are plastic but have a wood appearance. The plastic may be a wood color with coloring and texture representing grain. These crates may be placed directly on shelves so that consumers can shop directly from the crates. The wood appearance supports an association of farm-fresh, natural and/or organic with the produce contained therein.

SUMMARY

A collapsible crate disclosed herein includes a base and a plurality of walls pivotably connected to the base. Each of the walls is a single piece of molded plastic defining a plurality of "planks" having the appearance of wooden planks, such as with molded-in grain texture, knots and irregular (e.g. non-straight and/or non-repeating pattern) edges. The plastic may also be of a color similar to wood (e.g. brown).

The irregular edges may provide gaps between adjacent planks to provide ventilation to the crate. The knots may include knot holes to provide additional ventilation.

The planks may include horizontal planks extending between vertical planks. The vertical planks and horizontal planks may include an interior wall. Ribs extend from the edges of the interior wall toward the exterior of the crate. In other words, the "planks" may be concave, opening toward the exterior of the crate. This provides smooth surfaces toward the interior of the crate, rather than the free ends of ribs, to prevent damage to the contents of the crate, such as produce. The "corners" of the planks, i.e. the edges where the ribs extend from the walls of the planks, may be rounded to further provide a smooth surface toward the contents of the crate.

DETAILED DESCRIPTION OF EXAMPLE EMBODIMENTS

Figure 1:
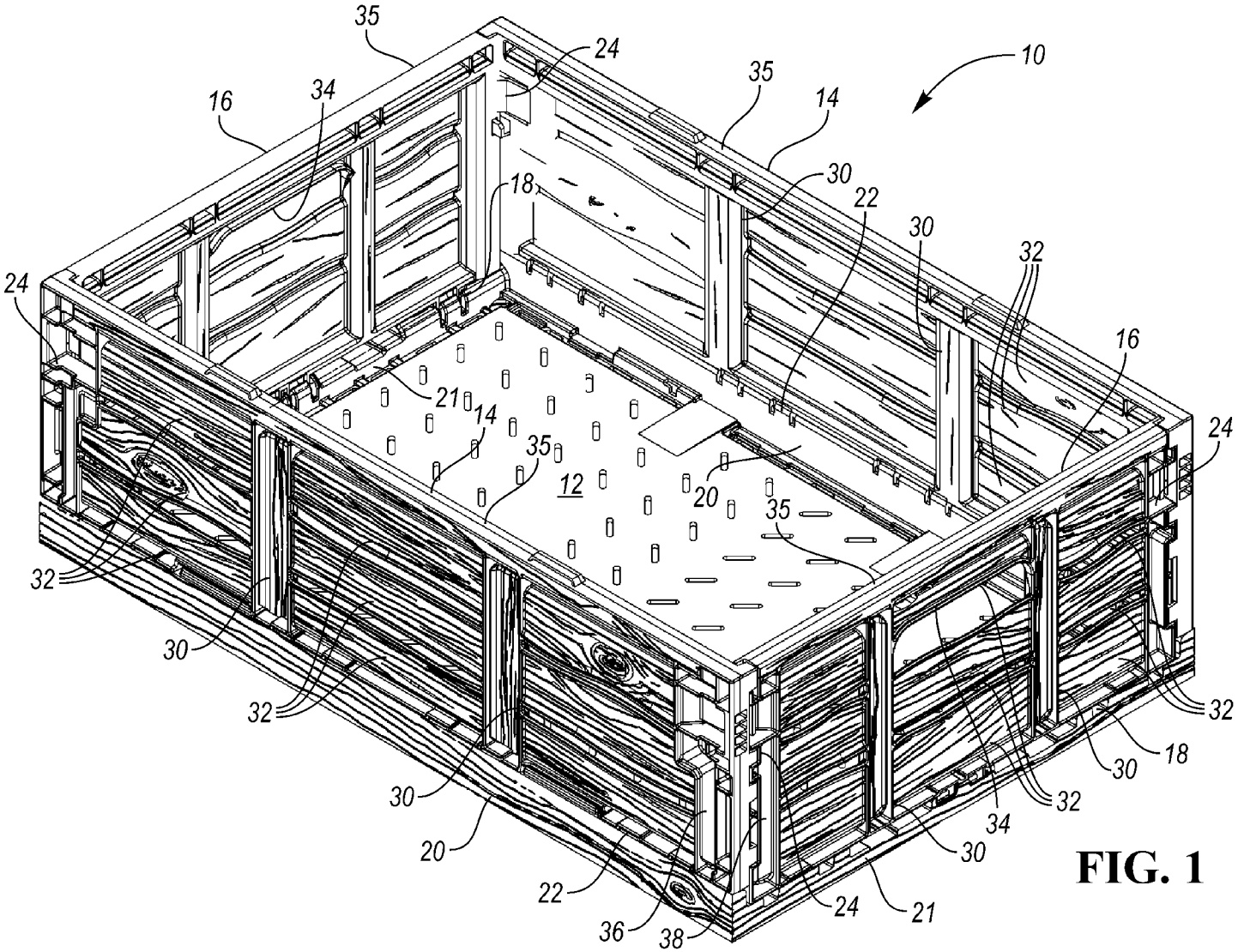
FIG. 1 is a perspective view of a first example crate.

A collapsible crate 10 according to one example is shown in FIG. 1. Generally, the crate 10 is a collapsible plastic crate 10, but with an appearance of a wooden crate. As will be explained below, some of the structural and ventilation features of the crate 10 are incorporated into or integrated with the simulated wood elements. Further, the interior surfaces of the crate 10 are all smooth, without protruding ends of ribs, so that the crate 10 can be used to carry fruit or other produce without damage.

The crate 10 includes a base 12 having a pair of opposed side walls 14 (or "long walls") pivotably connected to side edges thereof and a pair of opposed end walls 16 (or "short walls") pivotably connected to end edges thereof. The end walls 16 are pivotably connected to upstanding end flanges 21 of the base 12 by hinges 18. The side walls 14 are pivotably connected to upstanding side flanges 20 of the base 12 by hinges 22. The side flanges 20 are taller than the end flanges 21. The side walls 14 and end walls 16 are selectively secured to one another at corners of the crate 10 by latches 24 (many known latches are suitable).

The base 12 is injection molded as a single piece of suitable plastic. Each side wall 14 is injection molded as a single piece of suitable plastic. Each end wall 16 is injection molded as a single piece of suitable plastic.

Figure 2:
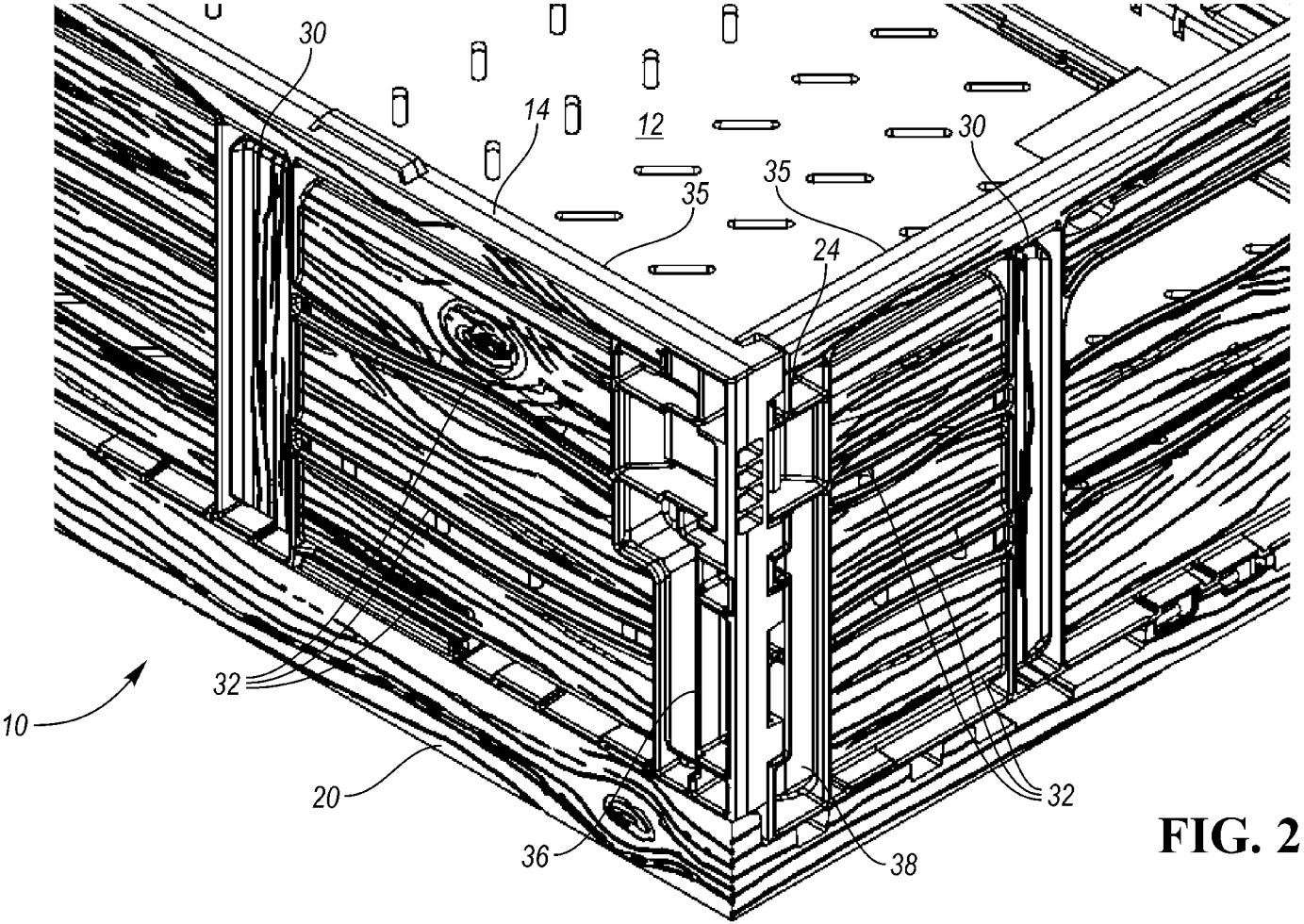
FIG. 2 is an enlarged view of a corner of the crate of FIG. 1.

Referring to FIGS. 1 and 2, each of the side walls 14 and end walls 16 includes a plurality of vertical planks 30, in this example, two. The vertical planks 30 have an appearance that simulates a wooden vertical crate component, i.e. a wooden vertical plank. A plurality of horizontal planks 32 extend between adjacent vertical planks 30 and between each of the vertical planks 30 and the corners of the crate 10. The side walls 14 have corner structure 36 and the end walls have corner structure 38, which may include structural ribs, interlocking elements and the latches 24. Again, contrary to the intended appearance as multi-component wood structures, each of the side walls 14 is molded as a single piece of plastic, as is each of the end walls 16. Further, as shown, exterior surfaces of the side walls 14, end walls 16, side flanges 20 and end flanges 21 have molded-in texture or pattern that gives a wood grain appearance.

An upper rail 35 forms the uppermost edge of each of the side walls 14 and end walls 16, extending above the horizontal planks 32 and vertical planks 30. The end walls 16 each have a handle opening 34 between two of the horizontal planks 32. The handle opening 34 is also defined between two vertical planks 30 in the end wall 16. As can be seen on the far walls of FIG. 1, the interior surfaces of the side walls 14 and end walls 16 are substantially smooth. For example, there are no free ends of ribs protruding toward the interior of the crate 10 from the walls 14, 16, at least below the upper rails 35.

Figure 3:
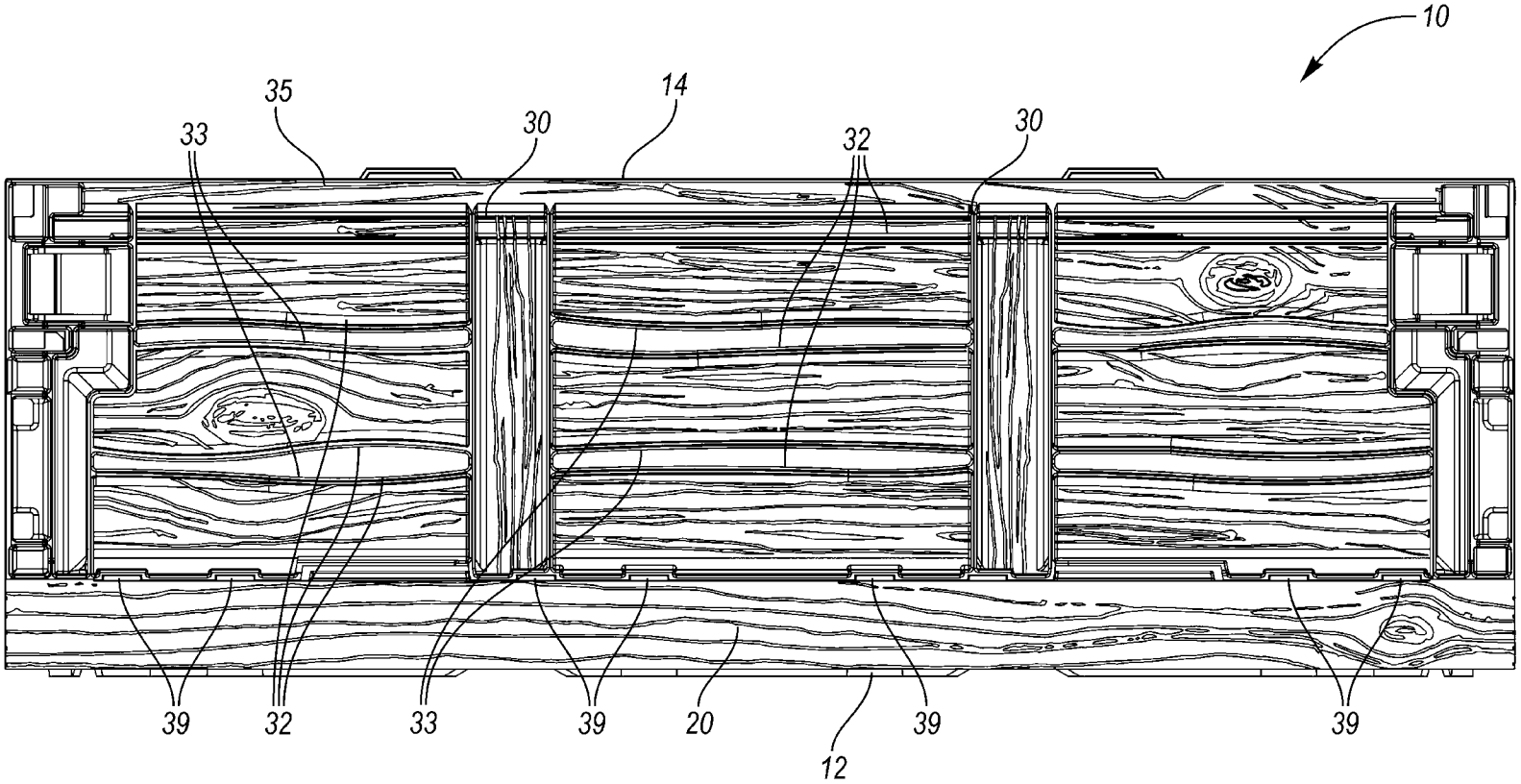
FIG. 3 is a side view of the crate of FIG. 1.

FIG. 3 is a side view of the crate 10. As shown, each of the horizontal planks 32 is irregularly shaped, to simulate natural wood planks. Each of the horizontal planks 32 includes upper and lower edges that are not completely straight; rather, they curve up and down a little in irregular patterns. This also creates irregular gaps 33 between the horizontal planks 32 that vary in width from one side to another and between different adjacent horizontal planks 32. The irregular edges and gaps further contribute to the natural wood plank appearance. The gaps 33 also provide ventilation to the interior of the crate 10. Lower vents 39 may be formed at the bottom edge of the side walls 14, between the side walls 14 and the side flanges 20. The vertical planks 30 on each side wall 14 are located ⅓ the distance from each end and are structural members that carry top load when an identical crate 10 is cross-stacked thereon.

Figure 4:
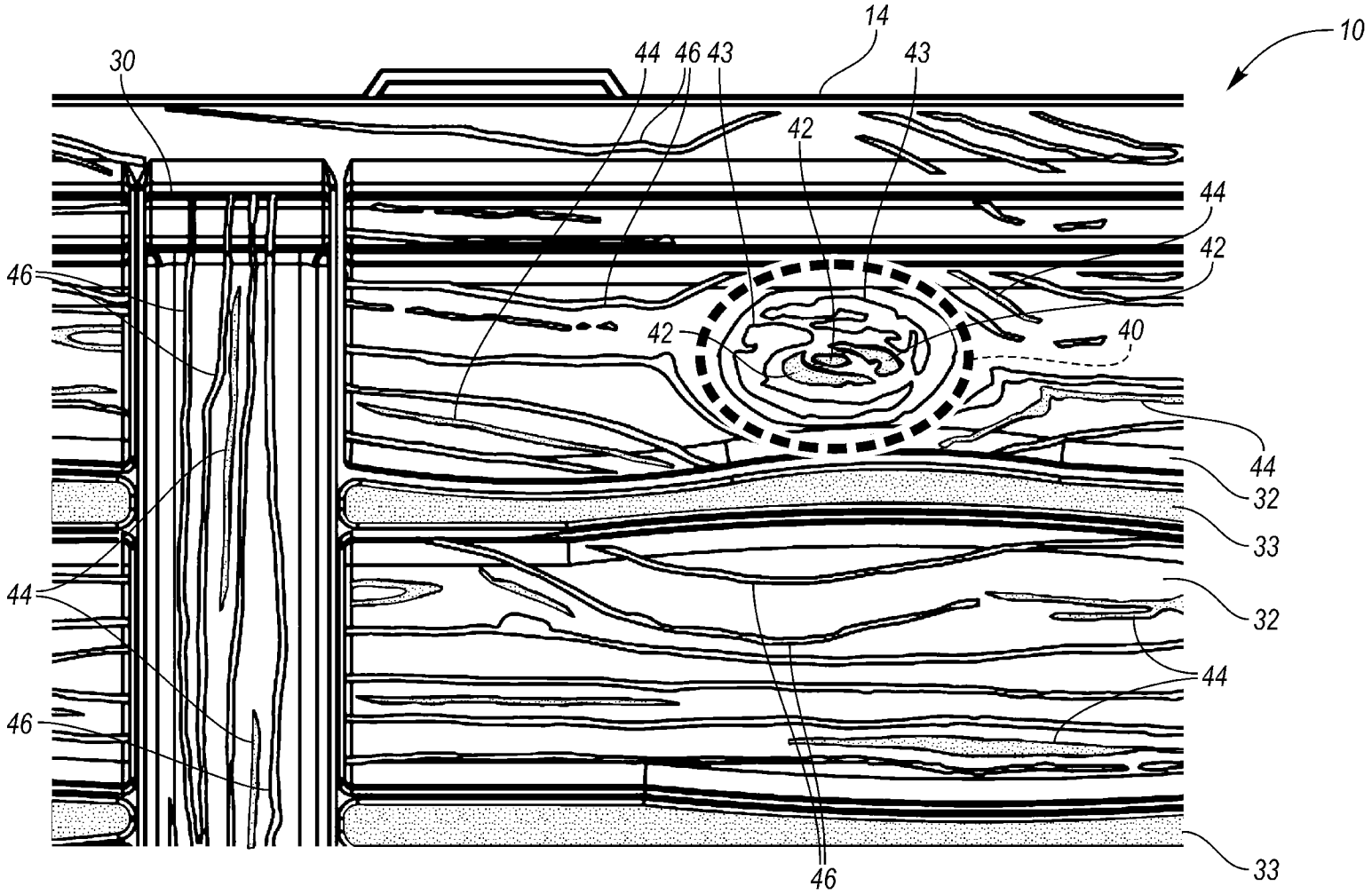
FIG. 4 is an enlarged view of a portion of the side view of FIG. 3 with ventilation gaps shaded for emphasis.

FIG. 4 is an enlarged view of a portion of FIG. 3 with openings, gaps or voids in the side wall 14 shaded for clarity. The gaps 33 between the horizontal planks 32 provide ventilation to the crate 10. As shown in FIG. 4, there are simulated knots 40 molded into the exterior surface of the horizontal planks 32 (and optionally, the vertical planks 30, not shown). The knots 40 include knot openings 42 that pass through the side wall 14 and knot etchings 43, which are only fairly shallow lines or channels molded into the horizontal planks 32 to provide the appearance of a knot. The knot openings 42 simulate the openings through natural wood plank knots that sometimes form and also provide additional ventilation to the interior of the crate 10. The horizontal planks 32 and vertical planks 30 further include grain openings 44, which simulate random splits along the grain of natural wood planks. The horizontal planks 32 and vertical planks 30 further include grain etchings 46 or texture, which are only fairly shallow lines or channels molded into the horizontal planks 32 to provide the appearance of wood grain.

Figure 5:
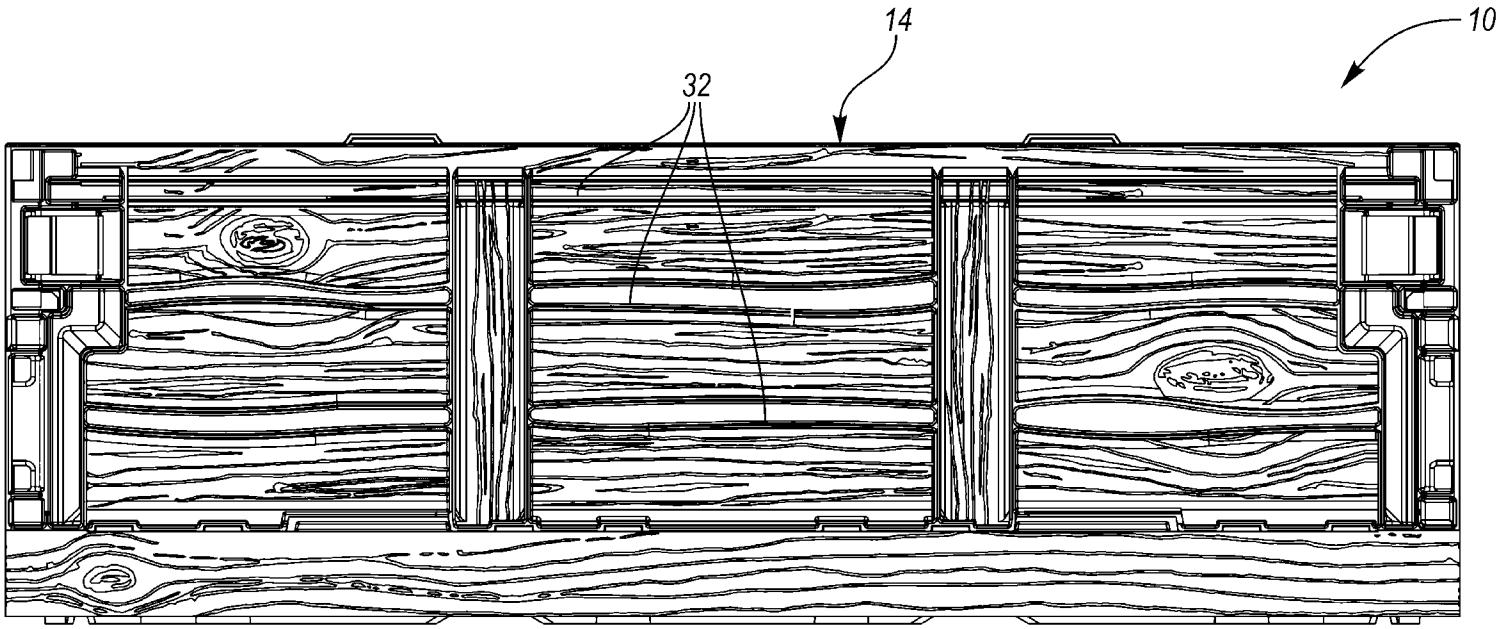
FIG. 5 is the other side view of the crate of FIG. 1.

FIG. 5 shows the opposite side wall 14. In the example shown, the two side walls 14 are formed from different molds with different patterns of the horizontal planks 32 (in terms of shape up of the edges, grain patterns and knots) and vertical planks 30 (at least in terms of grain patterns). This further contributes to the appearance as a natural wooden crate. Alternatively, the side walls 14 could be identical to one another, and the end walls 16 could be identical to one another.

Figure 6:
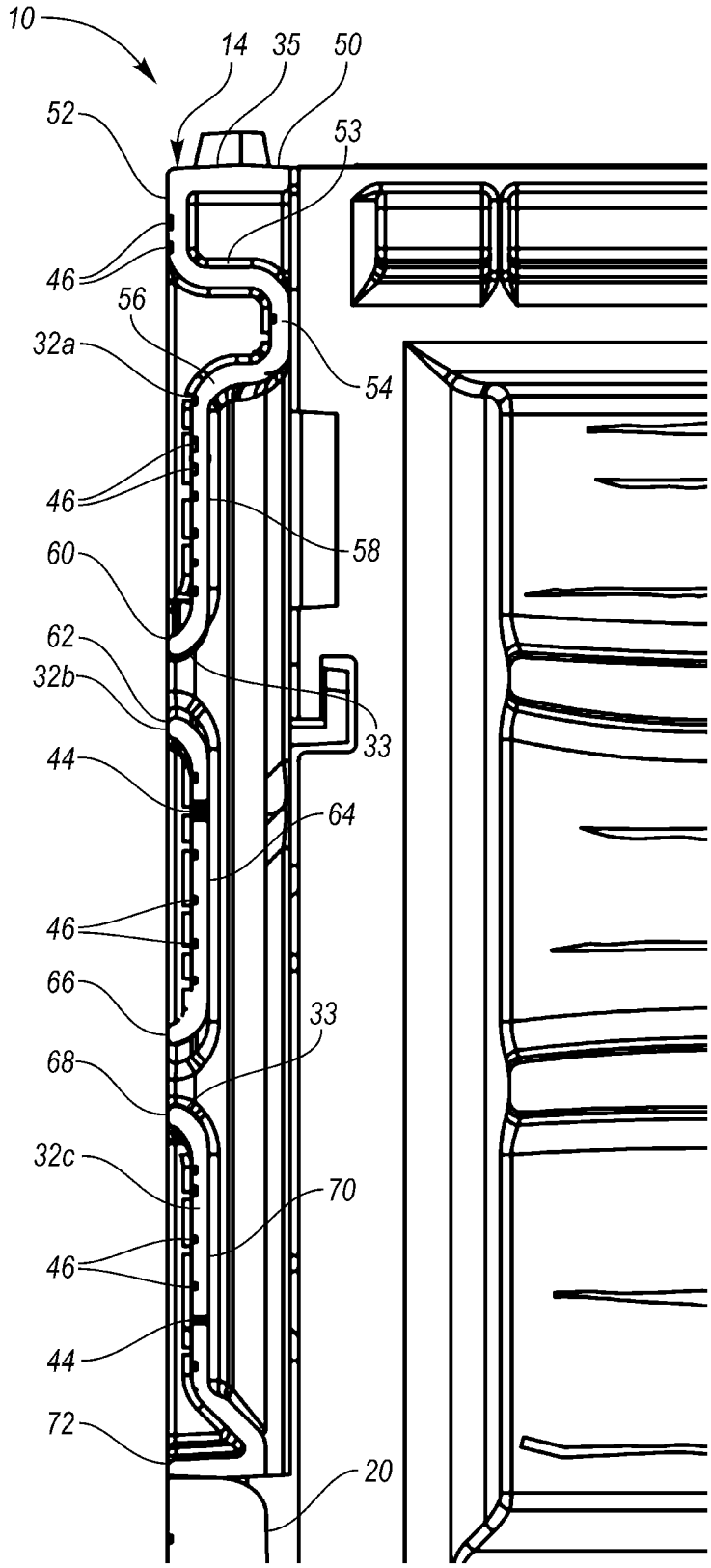
FIG. 6 is a vertical section through one of the side walls.

FIG. 6 is a section view through one of the side walls 14. Starting at the top, the upper rail 35 includes an uppermost wall projecting inward from an uppermost outer face 52 (which may have some grain etchings 46). A second horizontal wall 53 extends inward from a lower edge of the outer face 52 to form the inner surface 54 of the rail 35. All of the inwardly-facing surfaces have rounded edges so that there are no sharp corners facing the contents of the crate 10. A third horizontal wall 56 extends outward from a lower edge of the inner surface 54 of the rail 35 to an upper edge of the upper plank 32*a*, which includes an upper panel 58 having a lower rib 60 projecting outward at a lower edge thereof. Grain etchings 46 are formed on the exterior surface of the upper panel 58 of the upper plank 32*a*. The third horizontal wall 56 and lower rib 60 provide rigidity to the upper plank 32*a*. The outwardly-facing ribs leave a smooth face on interior surface of the upper planks 32*a*, so that smooth surfaces contact the fruit (or other goods) stored in the crate 10. The upper planks 32*a* are concave, facing outward of the crate 10. The upper planks 32*a* are convex, facing toward the interior of the crate 10. There is a gap 33 between the upper plank 32*a* and the middle plank 32*b*.

The middle plank 32*b* includes a middle panel 64 having an upper rib 62 and a lower rib 66 projecting outward from upper and lower edges thereof, respectively. Again, the transitions from the middle panel 64 to the upper rib 62 and lower rib 66 are rounded so that there are no sharp corners facing the interior of the crate 10. Grain etchings 46 and grain openings 44 are formed in the middle panel 64 of the middle plank 32. The outwardly-facing ribs leave a smooth face on interior surface of the middle planks 32*b*, so that smooth surfaces contact the fruit (or other goods) stored in the crate 10. The middle planks 32*b* are concave, facing outward of the crate 10. The middle planks 32*b* are convex, facing toward the interior of the crate 10. A gap 33 is between the middle plank 32*b* and the lower plank 32*c*.

The lower plank 32*c* includes a lower panel 70 having an upper rib 68 and a lower rib 72 projecting outwardly therefrom. The lower end of the lower panel 70 extends inward at an acute angle before the lower rib 72 extends outward fairly perpendicularly. Grain etchings 46 and grain openings 44 are formed in the lower panel 70 of the middle plank 32*b*. The outwardly-facing ribs leave a smooth face on interior surface of the lower planks 32*c*, so that smooth surfaces contact the fruit (or other goods) stored in the crate 10. The lower planks 32*c* are concave, facing outward of the crate 10. The lower planks 32*c* are convex, facing toward the interior of the crate 10.

Figure 7:
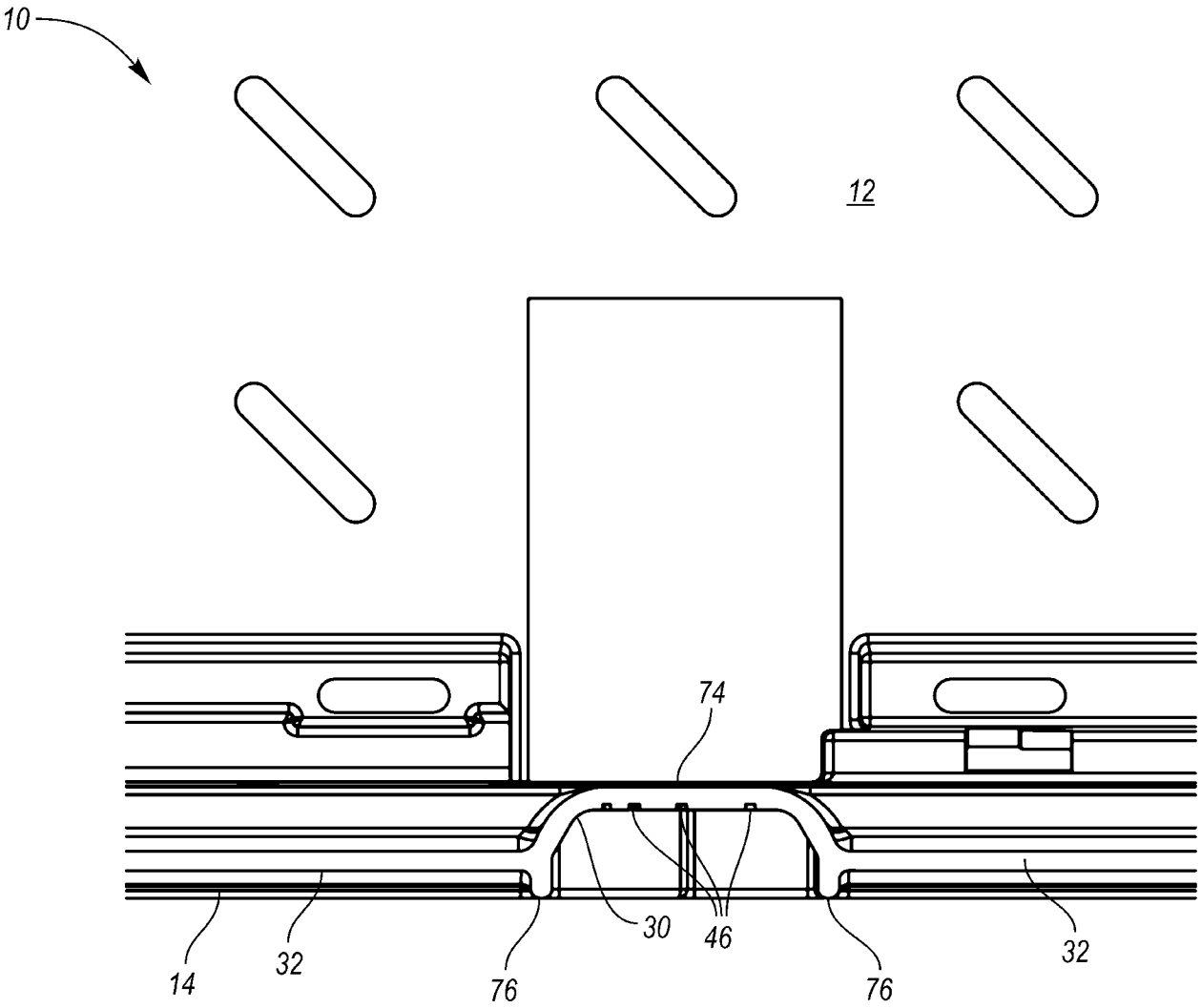
FIG. 7 is a horizontal section through one of the vertical planks, looking downward.

FIG. 7 is a section view through one of the vertical planks 30 in a side wall 14 and looking downward. The vertical planks 30 in the end walls 16 would be similar although they may be less deep and less substantial because they do not need to support an identical crate 10 cross-stacked thereon (as do the side wall vertical planks 30). As shown, the vertical plank 30 includes an inner wall 74 set inward of the container more than the horizontal planks 32 of the side walls 14. A pair of ribs 76 project outward from outer (rounded) edges of the inner wall 74 adjacent the horizontal planks 32. The vertical planks 30 are concave, facing outward of the crate 10 and convex, facing toward the interior of the crate 10. The exterior surface of the inner wall 74 may include grain etchings 46 (or grain openings, not shown, for ventilation).

Figure 8:
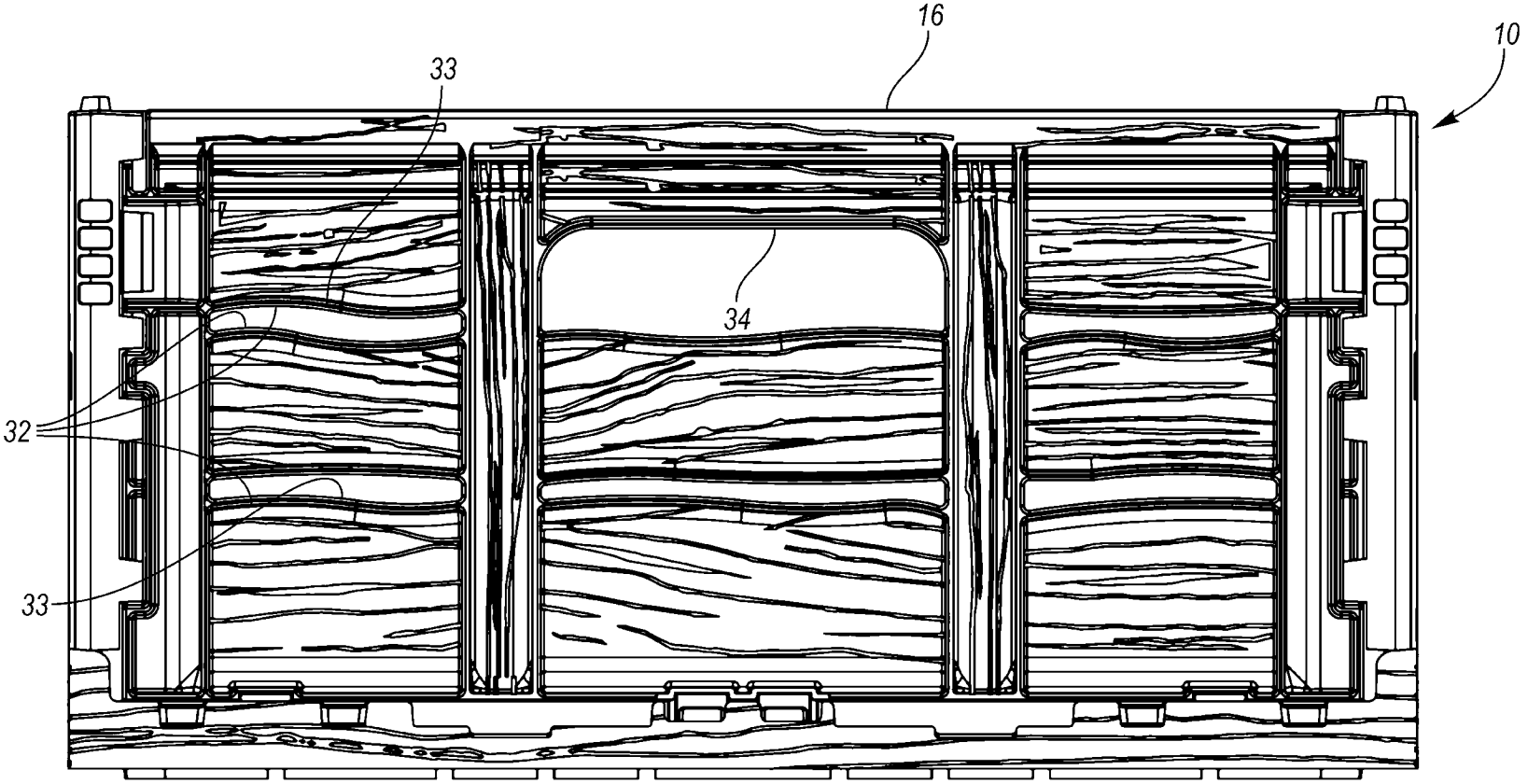
FIG. 8 is one end view of the crate of FIG. 1.
Figure 9:
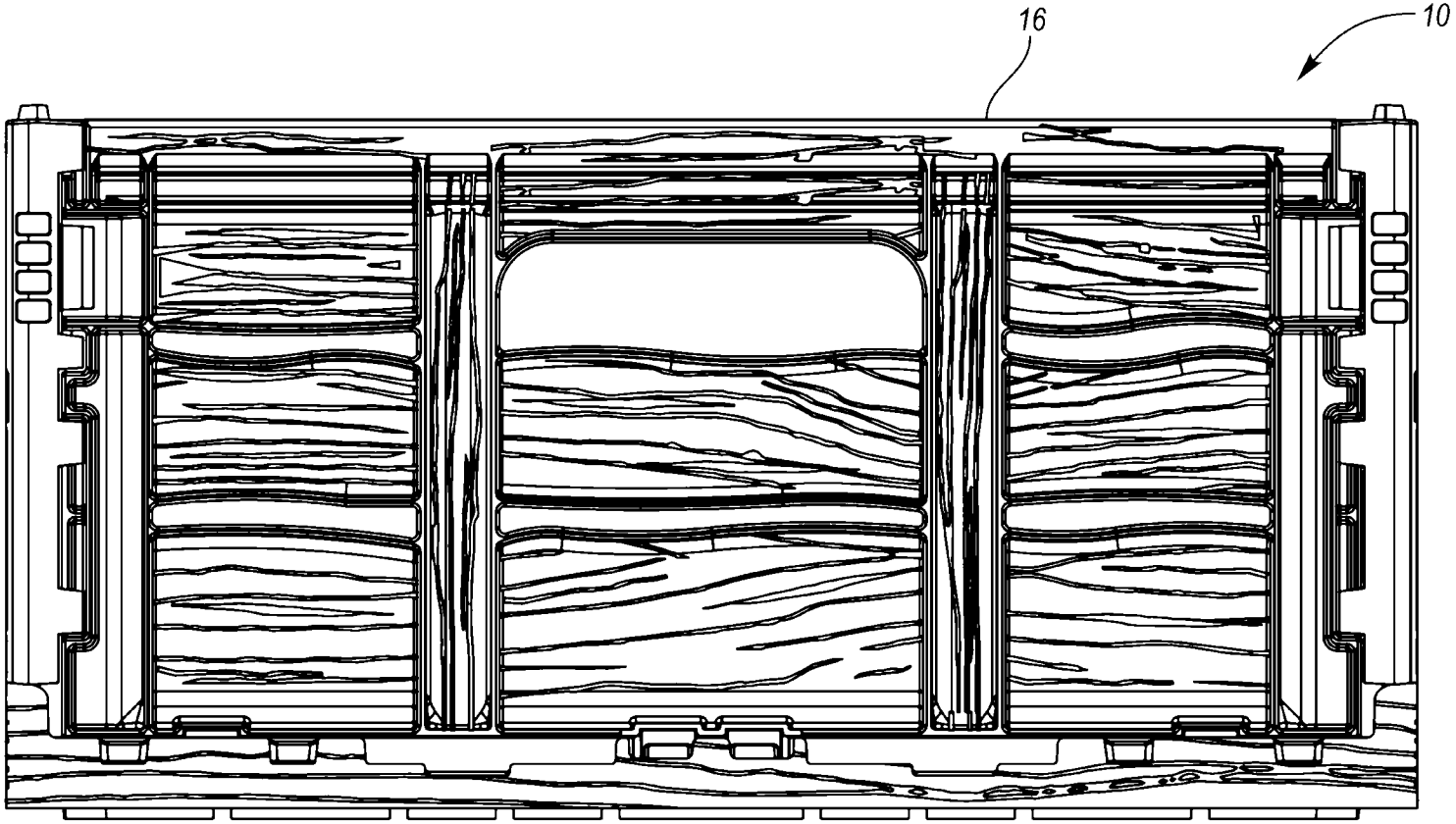
FIG. 9 is the other end view of the crate of FIG. 1.

FIGS. 8 and 9 are exterior views of the two end walls 16. Again, the example end walls 16 are molded to have different, irregularly-shaped planks 32, 30, different irregular gaps 33 and different grain patterns from one another.

Figure 10:
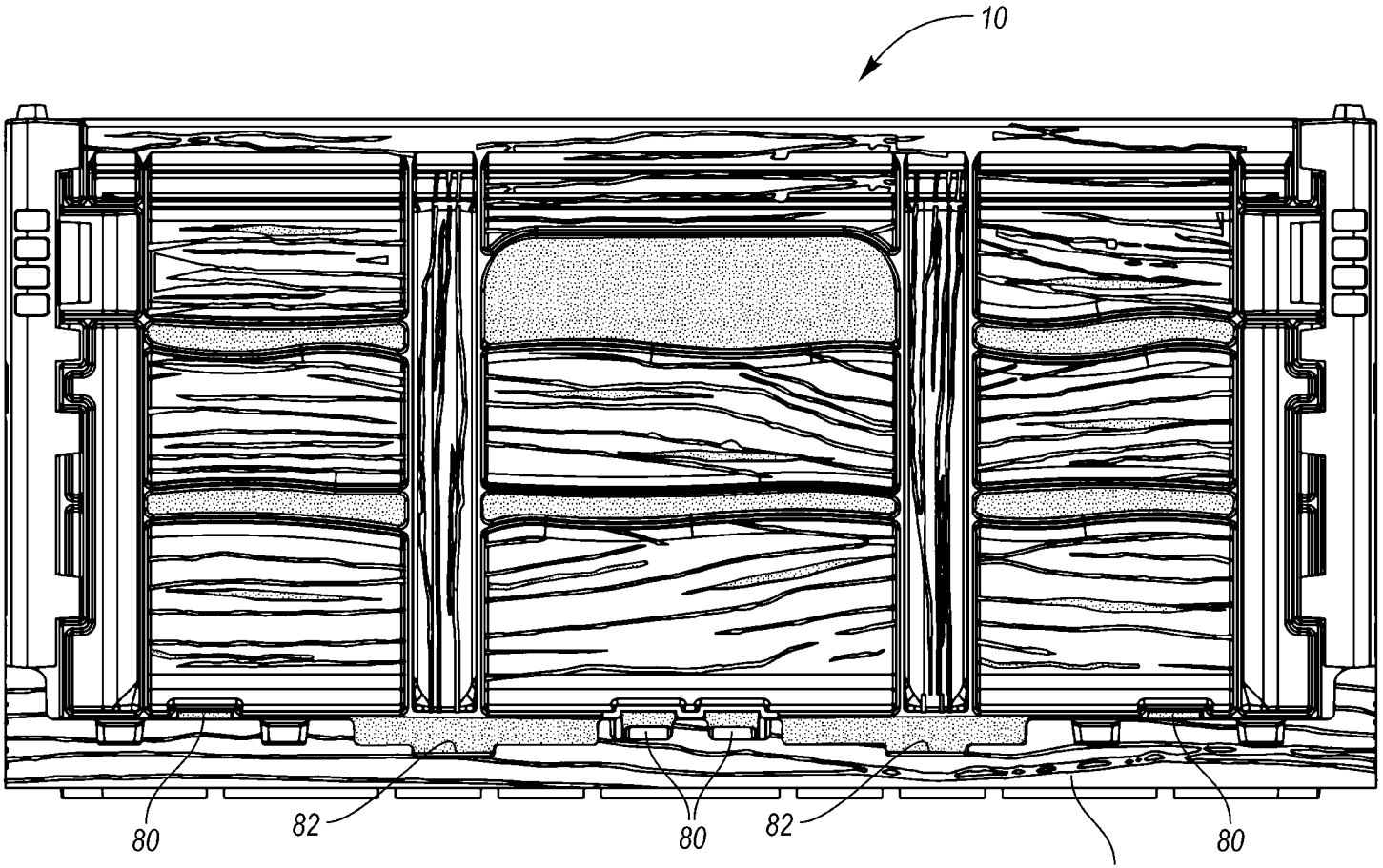
FIG. 10 shows the end view of the crate of FIG. 8 with the ventilation openings shaded for clarity.

FIG. 10 shows the end wall 16 of FIG. 9, with the gaps, openings and voids shaded for clarity. Lower vents 80 may be formed in lowermost edges of the end walls 16. End vents 82 may be formed in the end flanges 21 of the base 12 (between the end walls 16 and the end flanges 21).

Figure 11:
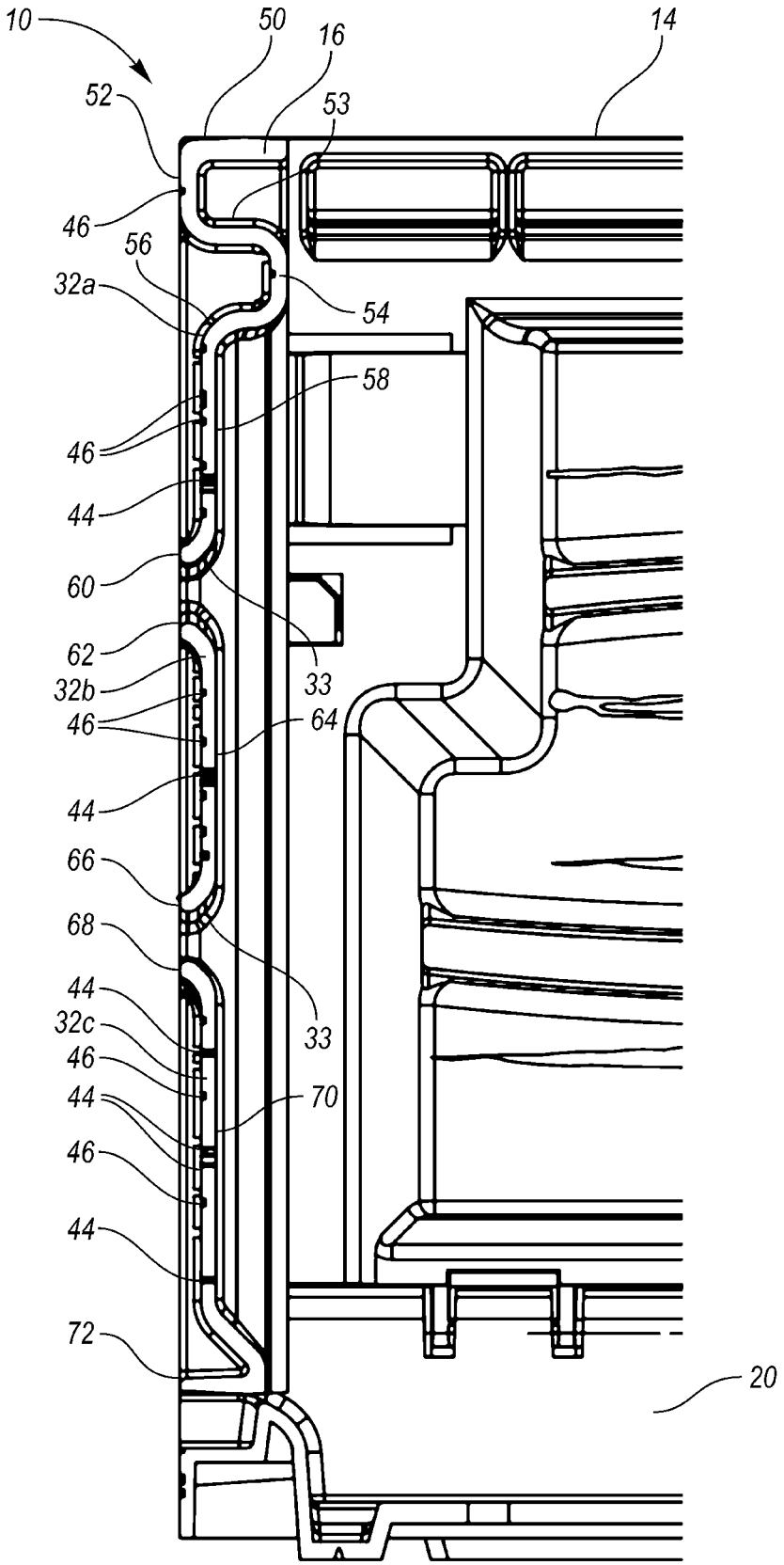
FIG. 11 is a section view through one of the end walls.

FIG. 11 is a section view through one of the end walls 16. Starting at the top, the upper rail 35 includes an uppermost wall projecting inward from an uppermost outer face 52 (which may have some grain etchings 46). A second horizontal wall 53 extends inward from a lower edge of the outer face 52 to form the inner surface 54 of the rail 35. A third horizontal wall 56 extends outward from a lower edge of the inner surface 54 of the rail 35 to the upper plank 32*a*, which includes an upper panel 58 having a lower rib 60 projecting outward at a lower edge thereof. Grain etchings 46 are formed on the exterior surface of the upper panel 58 of the upper plank 32*a*. The lower rib 60 provides rigidity to the upper plank 32*a*. The outwardly-facing ribs leave a smooth face on interior surface of the upper planks 32*a*, so that smooth surfaces contact the fruit (or other goods) stored in the crate 10. The upper planks 32*a* are concave, facing outward of the crate 10. The upper planks 32*a* are convex, facing toward the interior of the crate 10. All the transitions between adjacent surfaces are rounded, especially those facing the interior of the crate 10. There is a gap 33 between the upper plank 32*a* and the middle plank 32*b*.

Figure 12:
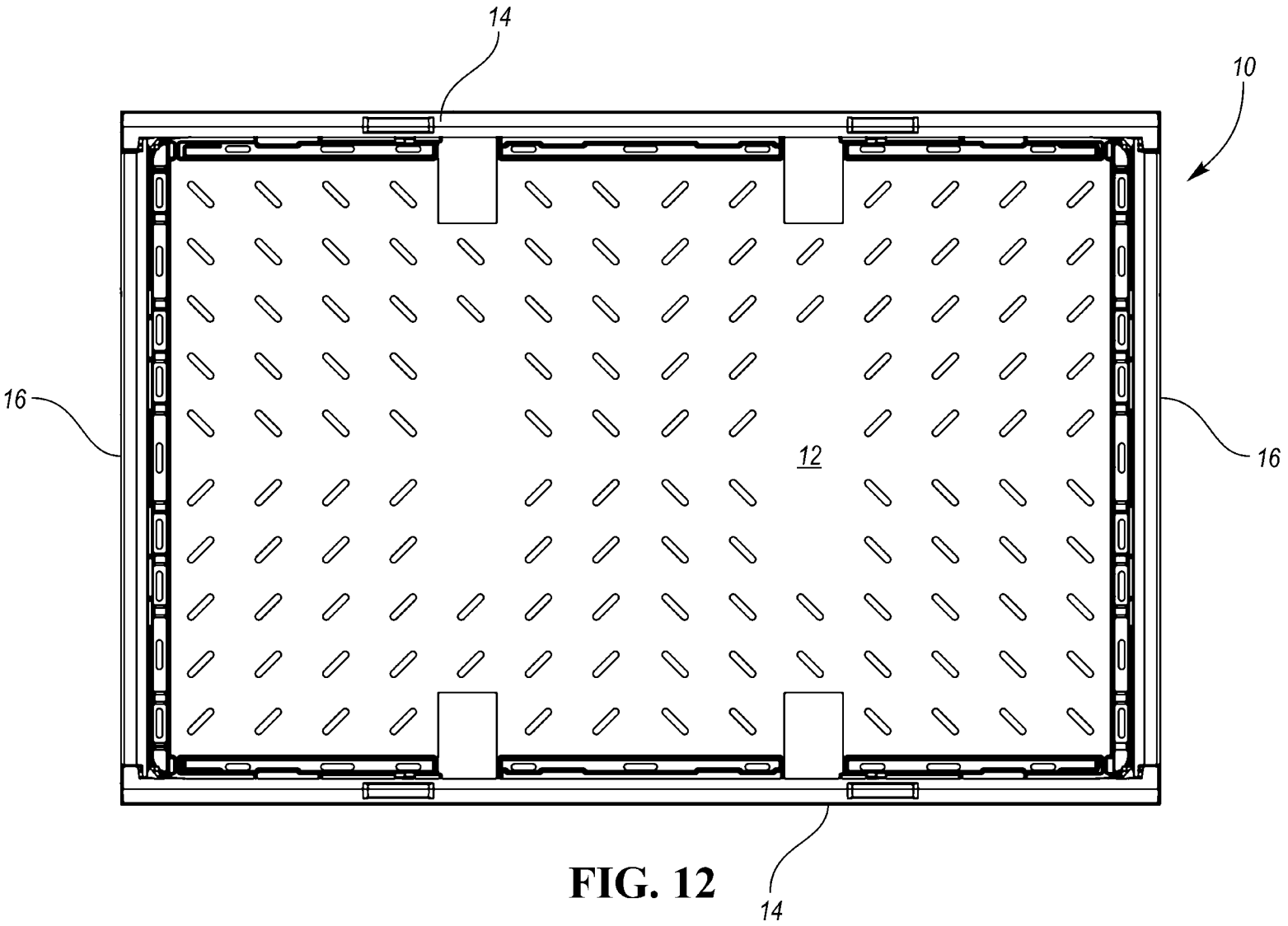
FIG. 12 is a top view of the crate of FIG. 1.
Figure 13:
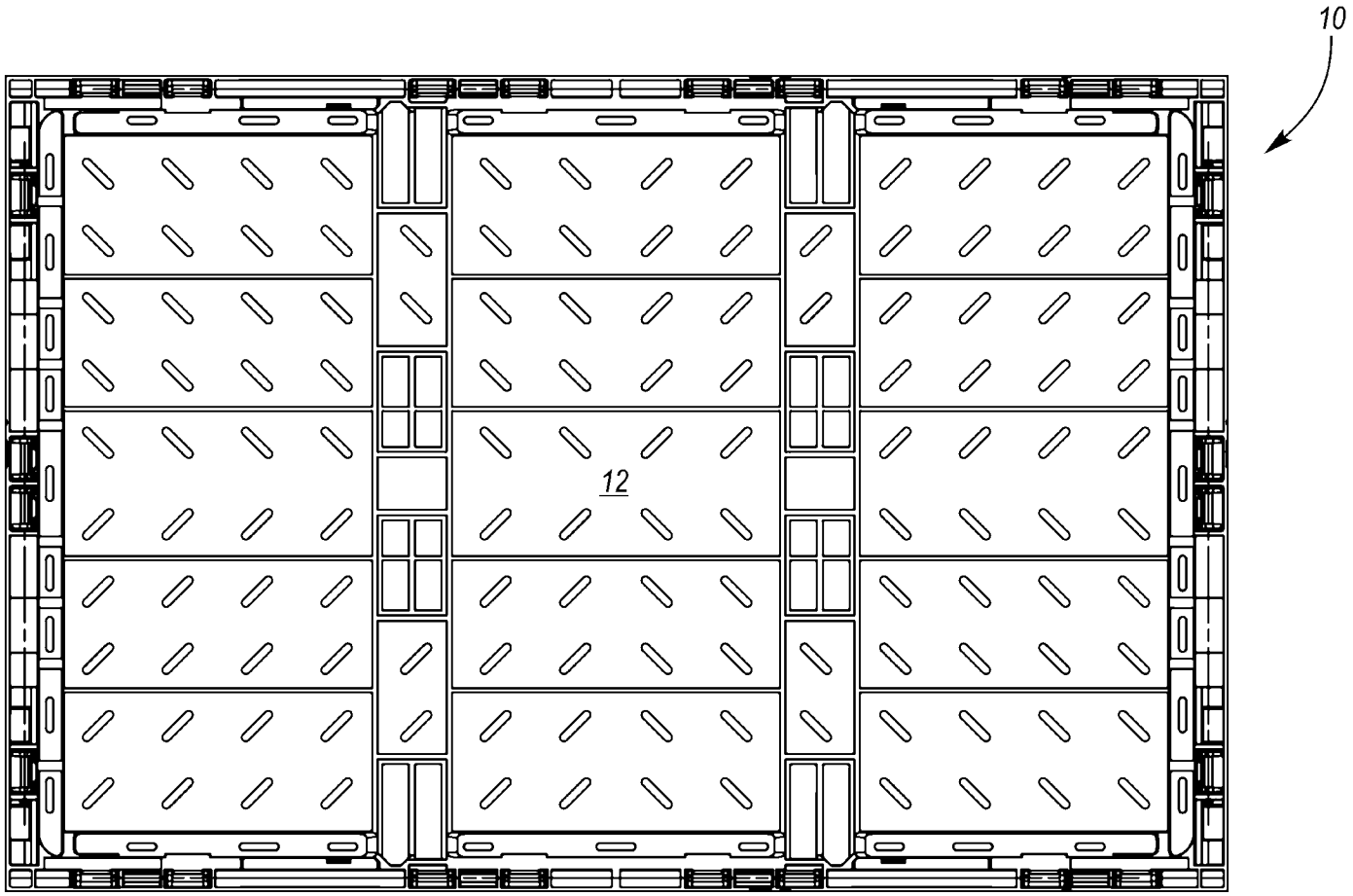
FIG. 13 is a bottom view of the crate of FIG. 1.

FIG. 12 is a top view of the collapsible crate 10. FIG. 13 is a bottom view of the collapsible crate 10.

Figure 14:
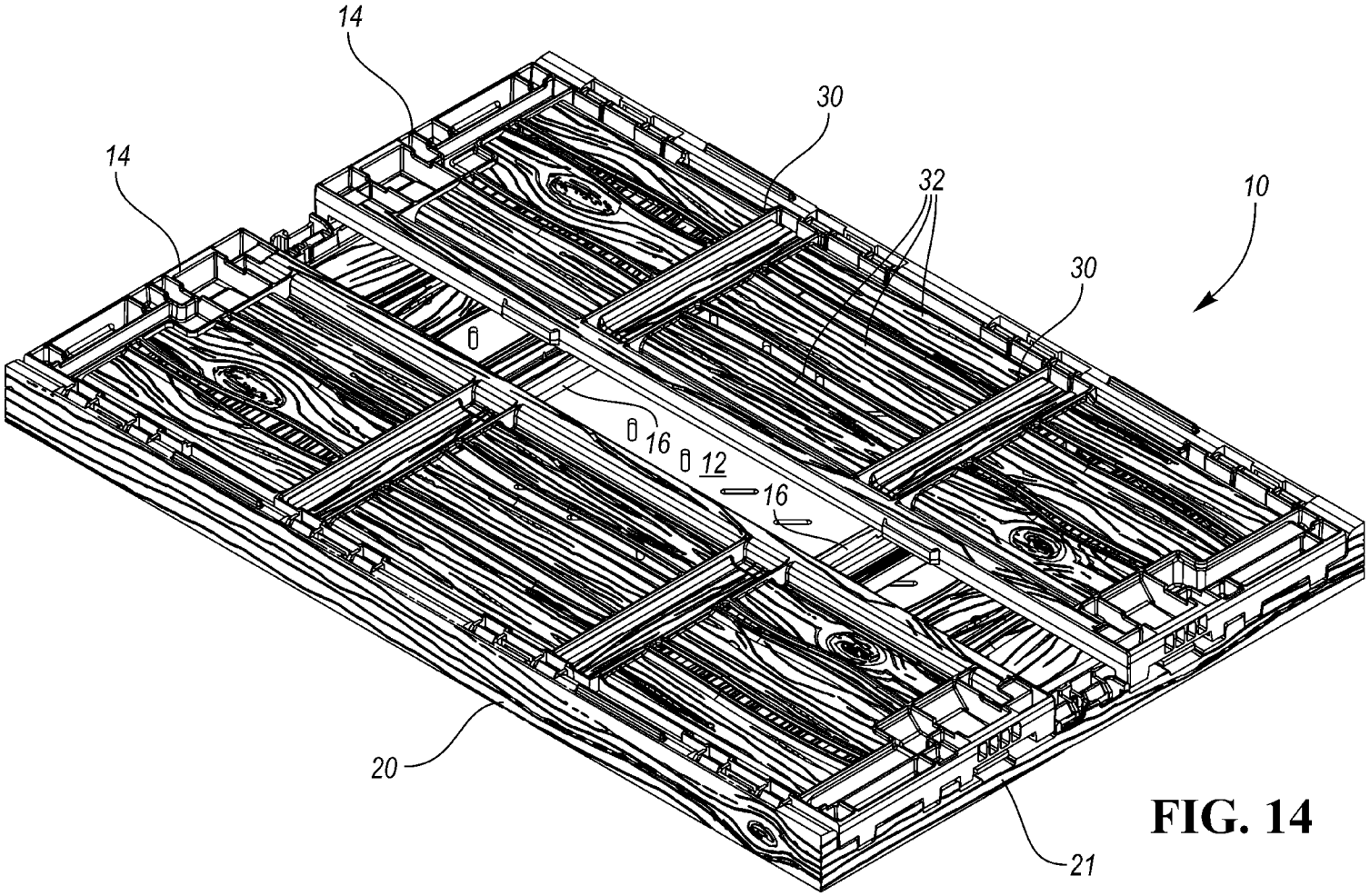
FIG. 14 is a perspective view of the crate of FIG. 1 in a collapsed position.

As shown in FIG. 14, after releasing the latches 24 (FIG. 1), the end walls 16 can be collapsed onto the base 12. The long walls 14 can then be collapsed onto the end walls 16 and the base 12.

Figure 15:
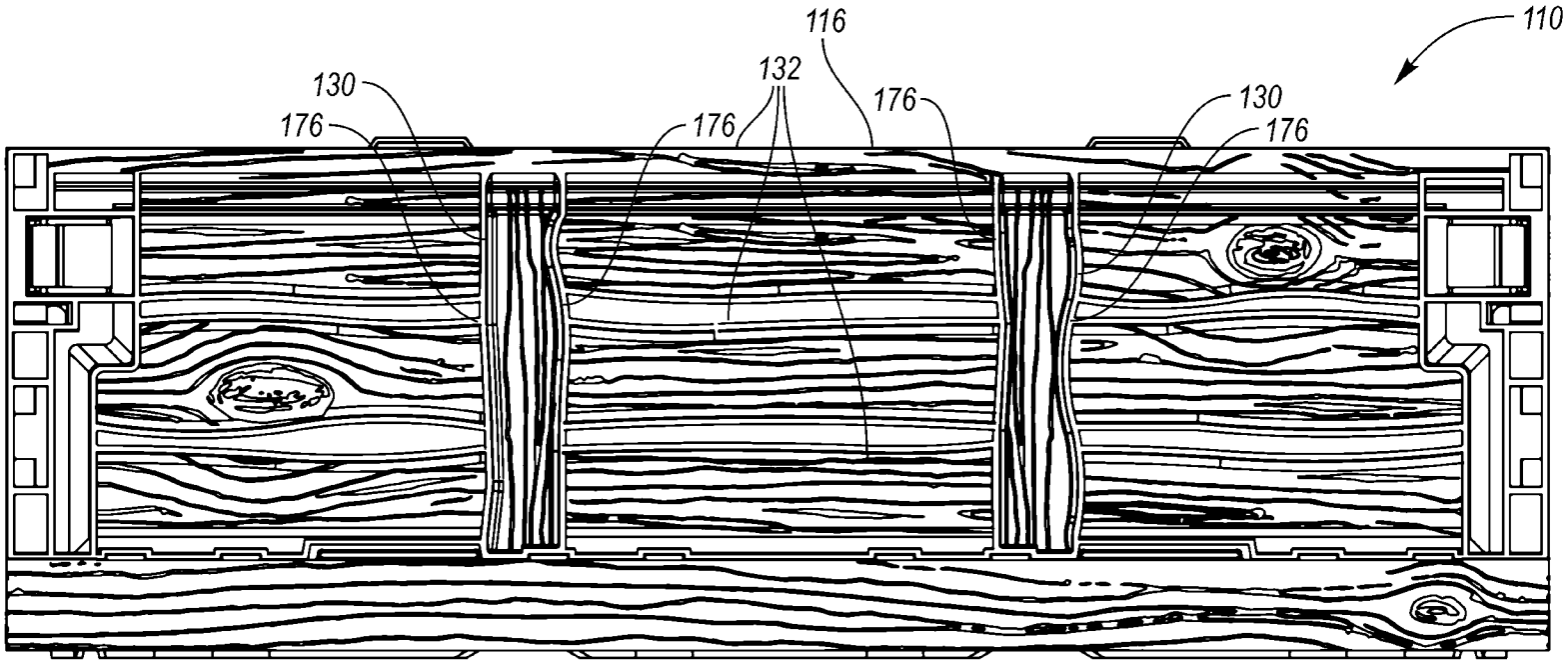
FIG. 15 is a perspective view of an alternate crate.

FIG. 15 shows an alternate crate 110, which is identical to the crate 10 as shown in FIGS. 1-14 except as otherwise shown in FIG. 15 or described below. The crate 110 includes alternate vertical planks 130 that have more irregular side edges, including ribs 176 of the vertical planks 130. The vertical planks 130 could have varying width and side edges that curve back and forth to give a more natural wood appearance.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, although the examples shown here are collapsible crate, these features could be provided in a non-collapsible crate or a nestable crate, in which case the base and the four walls could be integrally molded as a single piece of plastic.

What is claimed is:

1. A collapsible crate comprising:

a base; and a plurality of walls hingeably connected to the base and movably between an upright position generally perpendicular to the base and a collapsed position generally parallel to the base, the plurality of walls including a first wall, the first wall including a plurality of planks and a handle opening through the first wall, each of the planks including an interior wall portion and a plurality of ribs projecting outward from opposite edges of the interior wall portion toward an exterior of the crate, wherein the plurality of planks are generally parallel to one another and define gaps therebetween.

2. The collapsible crate of claim 1 wherein the plurality of planks in the first wall are integrally molded as a single piece of plastic.

3. A collapsible crate comprising:

a base; and a plurality of walls hingeably connected to the base and movably between an upright position generally perpendicular to the base and a collapsed position generally parallel to the base, the plurality of walls including a first wall, the first wall including a plurality of planks, each of the planks including an interior wall portion and a plurality of ribs projecting outward from the interior wall portion toward an exterior of the crate, wherein the plurality of planks have rounded corners transitioning from the interior wall portion to the plurality of ribs.

4. The collapsible crate of claim 1 wherein the plurality of planks have irregular outer edges.

5. The collapsible crate of claim 4 wherein the outer edges of the plurality of planks are shaped differently from one another.

6. The collapsible crate of claim 5 wherein the irregular outer edges form the gaps between the plurality of planks and wherein the gaps are irregularly shaped and have a varying width.

7. The collapsible crate of claim 6 wherein the plurality of planks are a plurality of generally horizontal planks, the first wall further including a plurality of vertical planks integrally molded with the plurality of generally horizontal planks as a single piece of plastic.

8. The collapsible crate of claim 7 wherein the plurality of vertical planks each have an interior wall portion spaced inwardly of the interior wall portions of the plurality of generally horizontal planks, the plurality of vertical planks each further including ribs projecting outward from opposite edges of the interior wall portion thereof.

9. The collapsible crate of claim 8 wherein the plurality of generally horizontal planks extend between the plurality of vertical planks.

10. The collapsible crate of claim 9 wherein the plurality of generally horizontal planks includes a first generally horizontal plank, the first generally horizontal plank including a simulated knot molded in an outer surface thereof, the simulated knot including knot openings through the first generally horizontal plank.

11. The collapsible crate of claim 10 wherein the plurality of generally horizontal planks include molded-in lines to create the appearance of wood grain.

12. The collapsible crate of claim 11 wherein the plurality of generally horizontal planks include grain openings through the planks.

13. The collapsible crate of claim 11 wherein the first wall includes an upper rail above the plurality of horizontal planks.

14. A collapsible crate comprising:

a base; and a plurality of walls hingeably connected to the base and movably between an upright position generally perpendicular to the base and a collapsed position generally parallel to the base, the plurality of walls including a first wall having a handle opening formed therethrough, the first wall including a plurality of horizontal planks extending between a pair of vertical planks, wherein the plurality of vertical planks each have an interior wall portion and ribs projecting outward from opposite edges of the interior wall portion thereof.

15. The collapsible crate of claim 14 wherein the plurality of horizontal planks include a molded-in grain texture.

16. The collapsible crate of claim 14 wherein the plurality of horizontal planks have irregular outer edges.

17. The collapsible crate of claim 16 wherein the outer edges of the plurality of horizontal planks are shaped differently from one another.

18. The collapsible crate of claim 17 wherein the plurality of horizontal planks are generally parallel to one another and define gaps therebetween, wherein the irregular outer edges form the gaps between the plurality of planks, wherein the gaps are irregularly shaped and have varying widths.

19. The collapsible crate of claim 18 wherein the plurality of horizontal planks integrally molded with the plurality of vertical planks as a single piece of plastic.

20. A collapsible crate comprising:

a base; and a plurality of walls hingeably connected to the base and movably between an upright position generally perpendicular to the base and a collapsed position generally parallel to the base, the plurality of walls including a first wall, the first wall including a plurality of planks and a handle opening through the first wall, the plurality of planks having irregular outer edges defining irregularly-shaped gaps between the irregular outer edges.

21. The collapsible crate of claim 20 wherein the plurality of planks are generally parallel to one another.

22. The collapsible crate of claim 21 wherein the plurality of planks are a plurality of generally horizontal planks, the first wall further including a plurality of vertical planks integrally molded with the plurality of generally horizontal planks as a single piece of plastic, wherein the plurality of generally horizontal planks extend between the plurality of vertical planks.

23. The collapsible crate of claim 22 wherein the plurality of vertical planks each have an interior wall portion spaced inwardly of the interior wall portions of the plurality of generally horizontal planks, the plurality of vertical planks each further including ribs projecting outward from opposite edges of the interior wall portion thereof.

24. A collapsible crate comprising:

a base; and a plurality of walls hingeably connected to the base and movably between an upright position generally perpendicular to the base and a collapsed position generally parallel to the base, the plurality of walls including a first wall, the first wall including a plurality of generally horizontal planks extending between generally vertical planks, wherein the plurality of generally vertical planks are integrally molded with the plurality of generally horizontal planks as a single piece of plastic, wherein the plurality of vertical planks each have an interior wall portion spaced inwardly of the interior wall portions of the plurality of generally horizontal planks, the plurality of vertical planks each further including ribs projecting outward from opposite edges of the interior wall portion thereof.

25. The collapsible crate of claim 6 wherein the plurality of planks in the first wall are integrally molded as a single piece of plastic.

26. The collapsible crate of claim 4 wherein the first wall includes an upper rail above the plurality of horizontal planks and wherein there are no ribs protruding inward on the first wall below the upper rail.

* * * * *